US006068590A

United States Patent [19]

Brisken

[11] Patent Number: 6,068,590

[45] Date of Patent: May 30, 2000

[54] DEVICE FOR DIAGNOSING AND TREATING HEARING DISORDERS

[75] Inventor: Axel F. Brisken, Fremont, Calif.

[73] Assignee: Hearing Innovations, Inc., Tucson, Ariz.

[21] Appl. No.: 08/957,189

[22] Filed: Oct. 24, 1997

[51] Int. Cl.[7] ..... H04R 25/00

[52] U.S. Cl. ..... 600/25; 607/55

[58] Field of Search ..... 600/25; 607/55–57; 381/68, 68.2, 68.3, 68.4, 68.6

[56] References Cited

U.S. PATENT DOCUMENTS 4,982,434 1/1991 Lenhardt et al. .

OTHER PUBLICATIONS

Shunichi Kono, et al, Some Consideration on the Auditory Perception of Ultrasound and Its Effects on Hearing, Journal of the Accustical Society of Japan (1985).

Lenhardt et al "Human Ultrasonic Speech Perception," *Science*, vol. 253, p. 82–84 (1991).

Camp "Underwater Acoustics", Wiley–Interscience, 1970.

Rosenthal et al "Vibrations of Ferroelectric Transducer Elements Loaded by Masses and Acoustic Radiation", IRE National Conventional Record 7, Part 6, 252.

Mason "Physical Acoustics, Principles and Methods", vol. 1, Part A, Academic Press, 1964.

Woollett, IRE International Convention Record 10, Part 6, p. 90, 1962.

Tims et al Piezoelectric Ceramic Reproducibility (for 33 Mode Transducer Application), Proceedings of the 6th IEEE International Symposium on Applns. of Ferroelectics, Lehigh U., Bethlehem, PA, p. 6245–627, Jun. 8–11, 1986.

Lan et al "Development of an Efficient Transducer Design Tool: Complete Finite Element Modeling of Transducer Performance Parameters on a PC", SPIE vol. 1733, 1992 p. 57–71.

*Primary Examiner*—John P. Lacyk

[57] ABSTRACT

A device for diagnosing and treating hearing disorders including a supersonic transducer which has a resonance frequency in the supersonic range. The transducer includes a piezoelectric ceramic tube which is compressed between a head mass and an inertial mass. A tensioning rod extends between the masses and is threadedly engaged with a nut which tensions the rod to adjust the compression on the ceramic tube. A tuning circuit can be used to increase the band width at resonance.

27 Claims, 9 Drawing Sheets

DEVICE FOR DIAGNOSING AND TREATING HEARING DISORDERS

BACKGROUND OF THE INVENTION

This invention relates to a device for diagnosing and treating hearing disorders. More particularly, the invention relates to a device for delivering auditory sensations to the profoundly deaf and others. The device is particularly suitable for supersonic bone conduction hearing devices, diagnosis and treatment of tinnitus, diagnosis and treatment of vestibular function conditions, echo location, and determination of individual sensitivity to ultrasonic signals. The ultrasonic frequency range is about 20 kHz to about 108 kHz or higher.

Early prior art starts with the use of significantly large and bulky accelerometer devices. A next generation of devices were bimorphs from Blatec, as illustrated in FIG. 3. These devices were higher frequency acoustic generators/sensors reportedly used to sense the presence or absence of materials on an assembly line. The devices consisted of a thin piece of piezoelectric ceramic, typically 0.040 inches thick, bonded directly onto a thin sheet of aluminum, typically 0.020 inches thick. When a voltage is placed across the electrodes of the ceramic, the material either shrinks or expands in the direction of the electric field, depending on the polarity of the device. This movement of the ceramic has no beneficial output with regard to the hearing assist devices. But in response to the same electric field, the ceramic also expands or shrinks in the lateral direction, perpendicular to the electric field. However, since the physical size of the ceramic is constrained by virtue of its lamination to the aluminum sheet, the ceramic will bow the lamination into an either concave or convex form, depending on the polarity. Application of an alternating voltage will then generate vibrations at the frequency of the input signal.

The devices of FIG. 3 did not have a strong natural resonance in the 20 to 40 kHz region as required for supersonic hearing devices, nor did they have the required band width. Further, under the drive conditions required for supersonic hearing devices, these devices very rapidly either delaminated, broke the ceramic, broke the electrical connections to the ceramic electrodes, or heated up and depolarized rendering the ceramic inert.

Another generation of devices was available from Motorola, based on their development and manufacturing of piezo tweeters, as illustrated in FIG. 4. The devices were redesigned to place a strong natural resonance in the supersonic frequency range of interest, but they still lacked the desired band width. The basic concept of a bimorph, however, was the same, with exactly the same consequences.

Yet a further generation of devices was developed by ECHO Ultrasound. ECHO felt constrained to continue the development of Motorola, and did succeed in opening up the band width. Yet, the basic concept of a bimorph failed. These devices generated excessive amounts of heat (severe burn potential) and failed rapidly, typically within seconds of operation.

As a result of naval sonar during and after World War II, power ultrasonics began to be developed. More relevant to the subject at hand was the field of piezoceramic longitudinal vibrators, as shown in FIG. 5, from the book of Leon W. Camp, "Underwater Acoustics", Wiley-Interscience, 1970. Indeed, Camp writes in his book:

> "The physical structure of these devices may be quite simple, consisting of a center section of active material which works between an inertial mass and a radiating diaphragm. FIG. 6.26 [FIG. 5 hereof] shows a diagrammatic arrangement of the components. In addition to the parts shown, there is usually a rod under tension through the center attached to front and back components for the purpose of holding the system under compression at all vibration levels."

An even earlier work, F. Rosenthal, and V. D. Mikuteit, (1959), IRE National Convention Record 7, Part 6, 252, and subsequently published as "Vibrations of Ferroelectric Transducer Elements Loaded by Masses and Acoustic Radiation" in IRE Transactions on Ultrasonics Engineering, February 1960, pp. 12–15 describes a mass loaded composite transducer featuring a ceramic tube and a bolt for compressive bias, as seen in FIG. 6. Rosenthal and Mikuteit go further to predict the operational resonant frequency of the device, as a function of the masses, the physical size of the ceramic tube, and the elastic constant of the ceramic. Of note, the resonant frequency is not dependent on the length of the device, as a function of resonant wavelength. The author's expression for the resonant frequency is simplified for the case of large masses. These same results are also published in W. P. Mason, "Physical Acoustics, Principles and Methods", Vol. 1, Part A, Academic Press, 1964.

In a companion work by R. S. Woollett, IRE International Convention Record 10, Part 6, p. 90, 1962, the case of air backing and fluid loading is addressed. This situation is the operational environment of the inventive device, where the fluid medium is the human body.

An alternative form of the above with a ceramic stack as compared to a ceramic tube is frequently used and also heavily described in the literature. A more recent paper by A. C. Tims, D. L. Carson, and G. W. Benthien, "Piezoelectric Ceramic Reproducibility (for 33 Mode Transducer Application), Proceedings of the 6th IEEE International Symposium on Applications of Ferroelectrics, Lehigh U., Bethlehem, Pa., pp. 6245–627, Jun. 8–11, 1986, clearly depicts the use of a stack as compared to the tube, as seen in FIG. 7.

The concept of an active component between a radiating mass and an inertial mass is still of significant interest in the transducer community, as manifested by the recent work of J. Lan, M. J. Simoneau, and S. G. Boucher, "Development of an Efficient Transducer Design Tool: Complete Finite Element Modeling of Transducer Performance Parameters on a PC", SPIE Vol. 1733, 1992, pp. 57–71. As seen in FIG. 8, they partition the components into incrementally small segments, individually and iteratively note the displacements to each segment, and predict overall device performance.

Although not easily observable from the literature, naval sonar has been utilizing these concepts for many years.

On the subject of tuning devices, virtually every textbook on transducers includes a section on tuning to impedance match or to broaden the bandwidth. No effort is made herewith to document the totality of electrical matching circuits.

SUMMARY OF THE INVENTION

The invention provides a transducer which has a resonant frequency in the supersonic range. A tuning circuit can be used to increase the band width at resonance. The transducer is particularly suitable for use in supersonic bone conduction hearing devices, diagnosis and treatment of tinnitus, echo location, diagnosis and treatment of vestibular function conditions, and other applications and procedures which use supersonic signals.

The transducer includes a piezoelectric ceramic tube which is compressed between a head mass and an inertial mass. A tensioning rod extends between the masses and is threadedly engaged with a nut which tensions the rod to adjust the compression on the ceramic tube.

DESCRIPTION OF THE DRAWING

The invention will be explained in conjunction with an illustrative embodiment shown in the accompanying drawings, in which.

DESCRIPTION OF SPECIFIC EMBODIMENT

Figure 1:
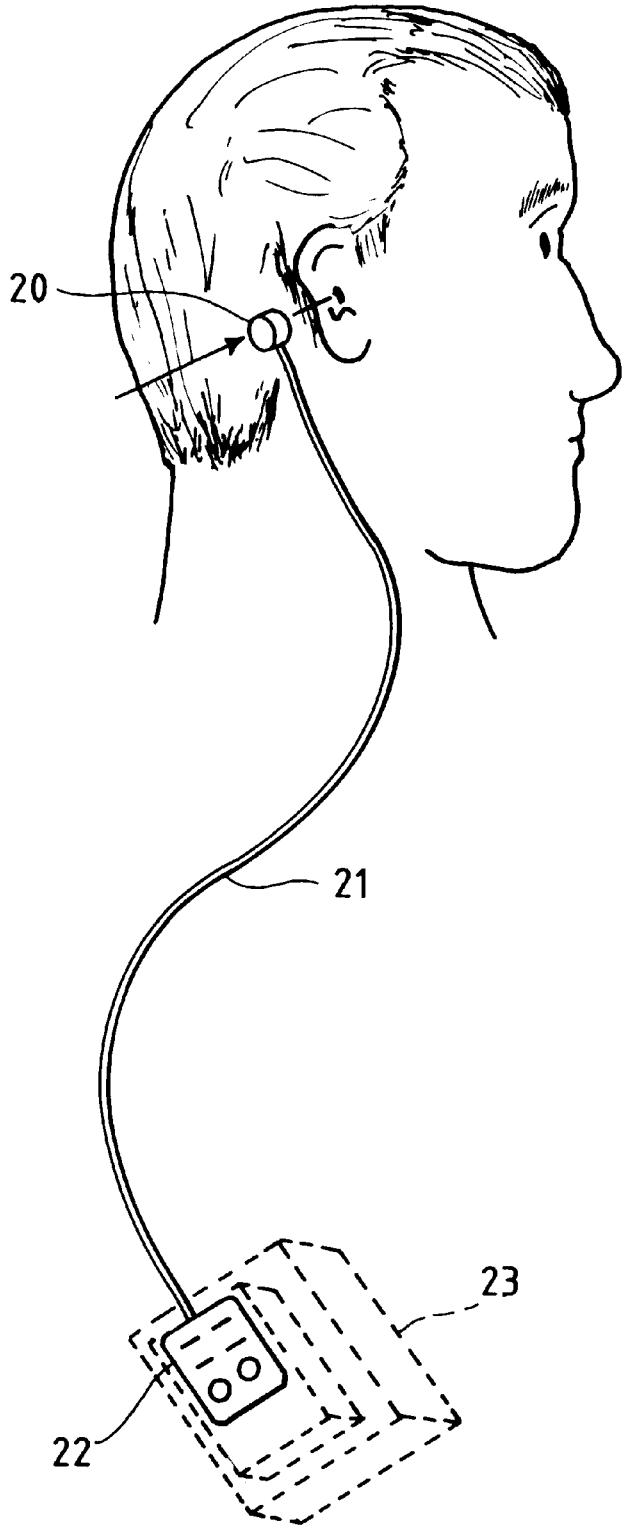
FIG. 1 illustrates a supersonic transducer formed in accordance with the invention being used as a hearing assist device.

FIG. 1 illustrates a supersonic hearing assist device which includes a transducer 20, a cable 21, and a tuning circuit 22 which is mounted within an electronic housing 23. The transducer is held up against the mastoid process of the temporal bone. The transducer can also be applied to other surfaces of the human body, for example, the wall of the ear canal, the middle of the human forehead, the human tooth, human clavicle, human spine, or other bones. For a complete description of a supersonic bone conduction hearing aid and its method of use, see Lenhardt et al U.S. Pat. No. 4,982,434 which is incorporated herein by reference. In general the housing 23 includes a microphone for receiving sounds in the auditory frequency range and a device for amplifying and converting the frequencies to the supersonic range and for applying electrical signals to the transducer.

Figure 2:
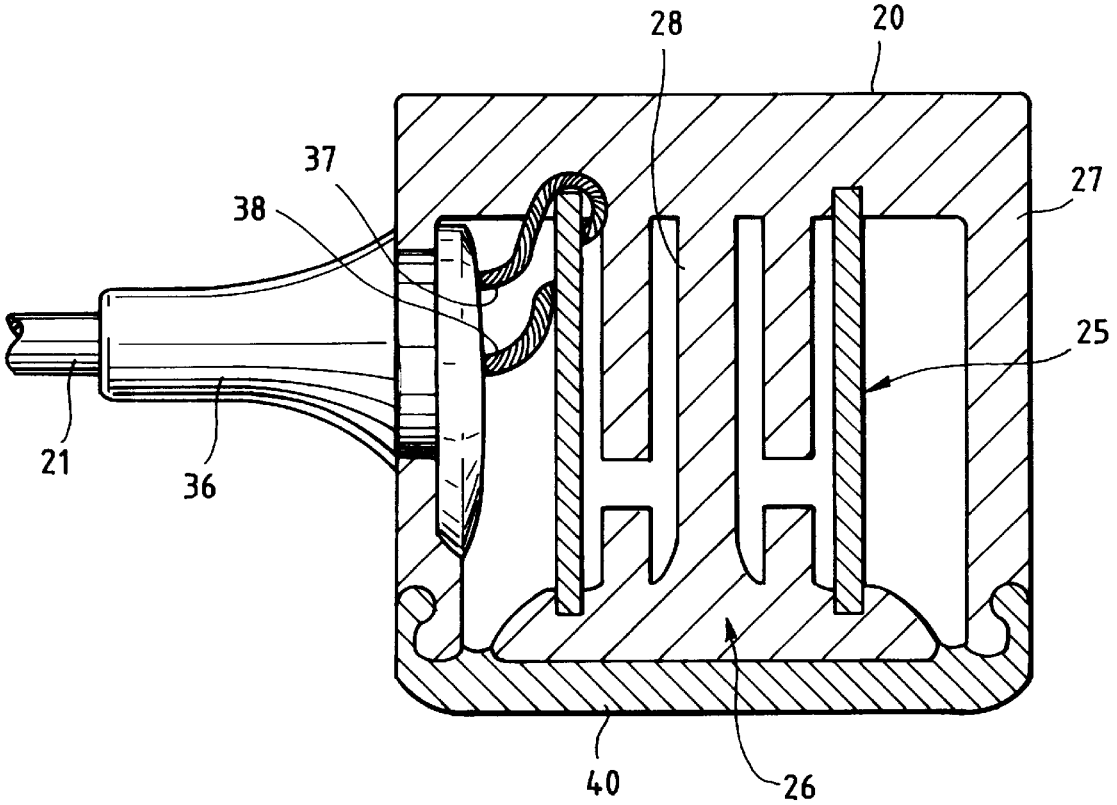
FIG. 2 is an enlarged sectional view of the transducer.
Figure 3:
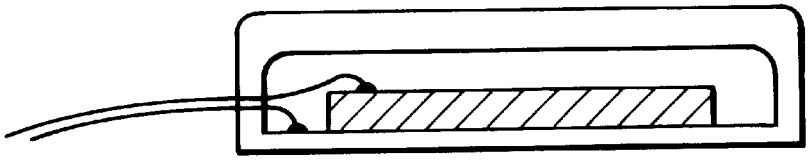
FIGURE 3 PRIOR ART
FIGS. 3–8 illustrate prior art devices.
Figure 4:
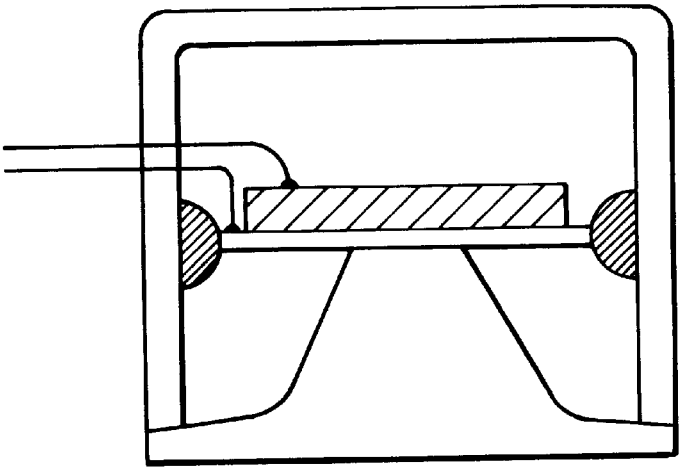
FIGURE 4 PRIOR ART
Figure 5:
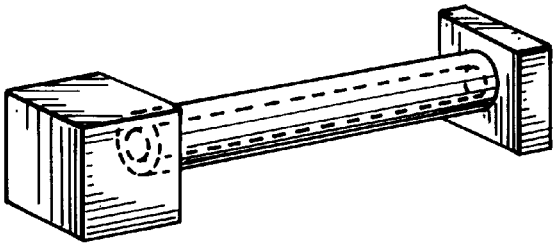
FIGURE 5 PRIOR ART
Figure 6:
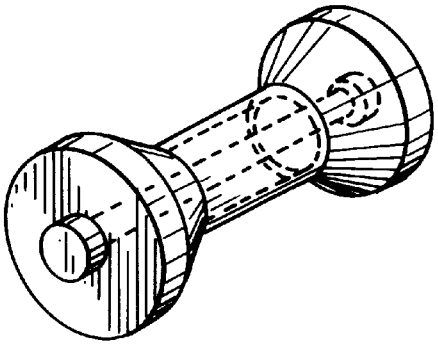
FIGURE 6 PRIOR ART
Figure 7:
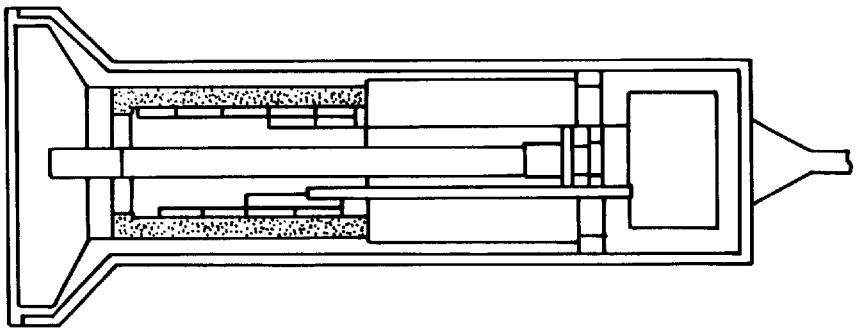
FIGURE 7 PRIOR ART
Figure 8:
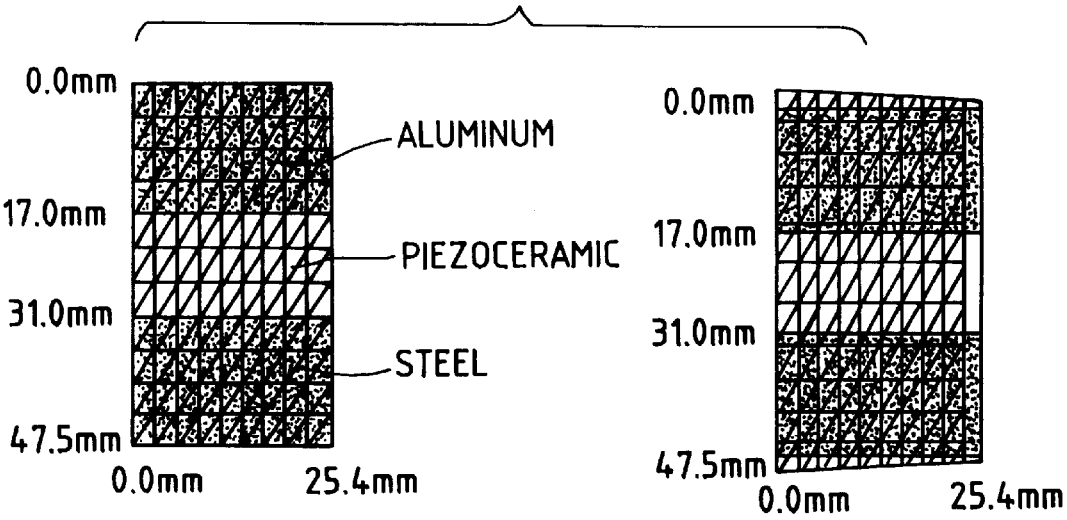
FIGURE 8 PRIOR ART

Referring to FIG. 2, the transducer 20 is best described as a piezoelectric longitudinal vibrator and includes a central piezoelectric ceramic tube 25, a radiating surface or head mass 26, and an inertial or tail mass 27. The radiating surface and inertial mass are tied together by a tensioning rod 28 to keep the assembly from self destructing as a result of large displacements of the radiating surface. The inertial mass is also the housing assembly for the device.

Figure 9:
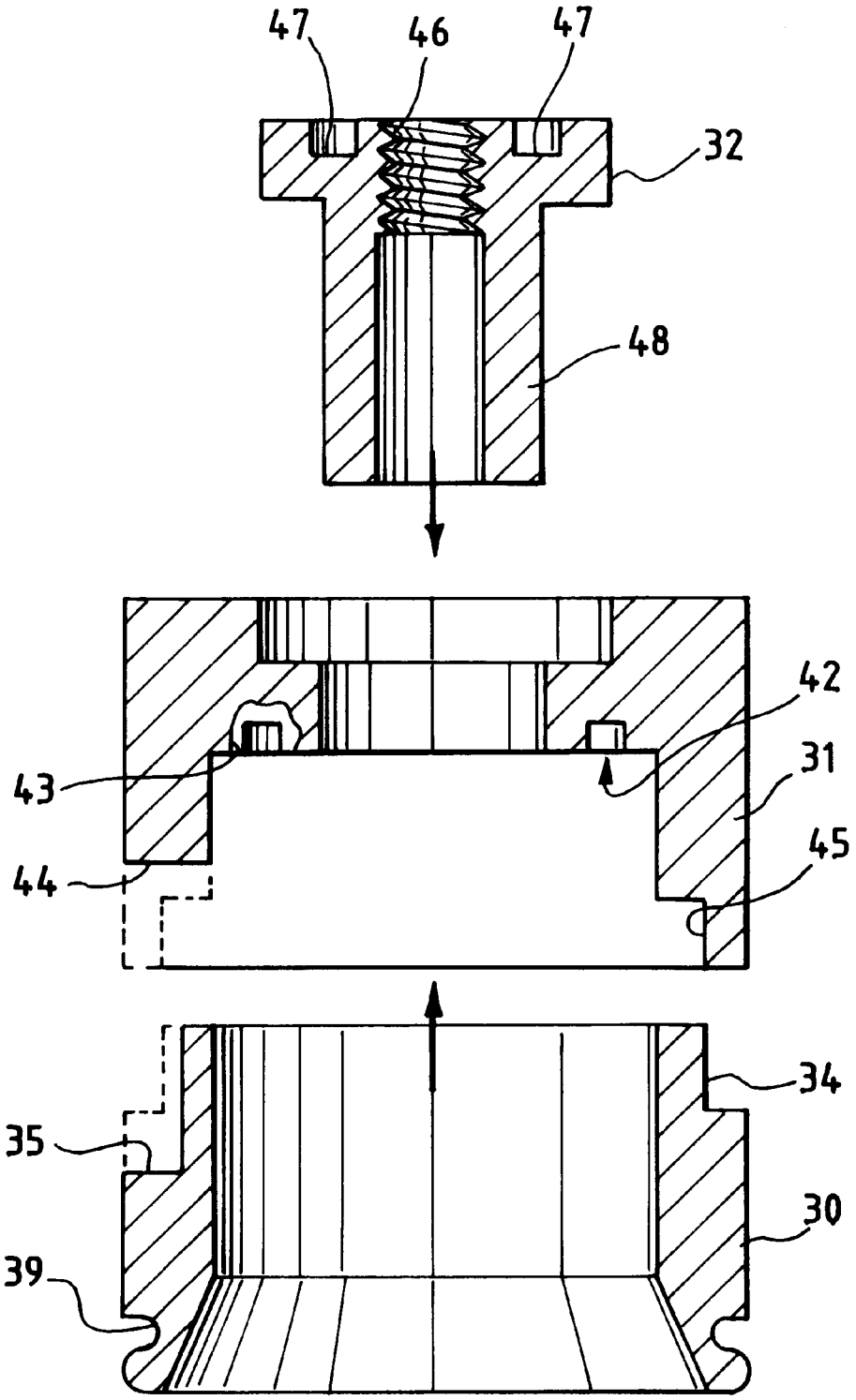
FIG. 9 is an exploded sectional view of the tail mass assembly of the transducer.

Referring to FIG. 9, the inertial mass 27 can be formed from separate components which include a generally cylindrical housing 30, a back plate 31, and a nut 32.

The housing 30 represents the front half of the transducer inertial mass or housing assembly. It includes an outer wall with a recess 34 for mating with the back plate 31. One side is provided with a half capture ring 35 for clamping onto the cable strain relief 36 (FIG. 2). At this point, the inside diameter of the housing is carved out to provide a channel for transducer wiring 37 and 38 (FIG. 2). On the outer front surface, the housing features a retention ring 39 for a silicone rubber cap 40 (FIG. 2) on the transducer face. On the inner front diameter, the housing wall is tapered outward to allow for the taper on the head mass 26 (FIG. 2).

The back plate 31 features an internal slotted ring 42 for the capture and adhesion of the piezoelectric ceramic tube 25 (FIG. 2). On one side of the back plate at the site of the hole for the cable and strain relief 36 (FIG. 2), there is a small hole 43 with a diameter approximately three times the nominal width of the slot 42. The electrical lead 37 for the inner electrode of the ceramic tube is passed through this hole around the bottom of the ceramic to the inner electrode. On this same side of the back plate, there is a matching hole 44 for the cable and strain relief 36 (FIG. 2). The inner wall of the back plate is further recessed in this area to allow for the placement of the electrical leads 37 and 38 (FIG. 2) to the inner and outer cylindrical electrodes of the ceramic tube. The front of the back plate features an inner wall cut back 45 to provide for a cylindrical lap joint with the housing.

The nut 32 comprises typically four complete 4-40 threads 46 to tension the tensioning rod 28 (FIG. 2). Two holes 47 on the back surface of the nut allow for the pins of a spanner wrench to tighten the nut. The back walls of the nut and back plate 31 are in the same plane. The nut also features an inner column 48 of metal, with an outer diameter to fit inside the ceramic tube 25 (FIG. 2) and an inner diameter to not interfere with the tensioning rod 28 (FIG. 2). The length of this column is designed to be as long as possible without interfering with the radiating surface or head mass 26.

In general, the entire housing assembly is designed for the maximum volume of metal to achieve the greatest inertial mass. If the radiating mass and the inertial mass have the same mass, then the acoustic radiation will be divided equally between the front and back surfaces. As more mass is accumulated in the tail mass, a greater fraction of displacement will occur at the head mass. For a tail mass to head mass ratio of 10:1, for example, the emission from the tail mass is 20 dB down from the emission from the head mass. The emission ratio is thus in competition with the physical size of the device.

The material of the housing assembly is selected to be a hardened stainless steel, typically a 416 stainless steel hardened to Rockwell 35, to assure for minimal distortion of the transducer assembly. Any distortion of the housing assembly will be converted to heat, in addition to reducing the effective head mass emission.

The overall physical size of the housing assembly is typically 0.75 inches in diameter, and 0.72 inches in length. The nominal mass of the collective housing assembly is typically 26 grams.

The housing 30 and back plate 31 are typically bonded with a penetrating epoxy.

Figure 10:
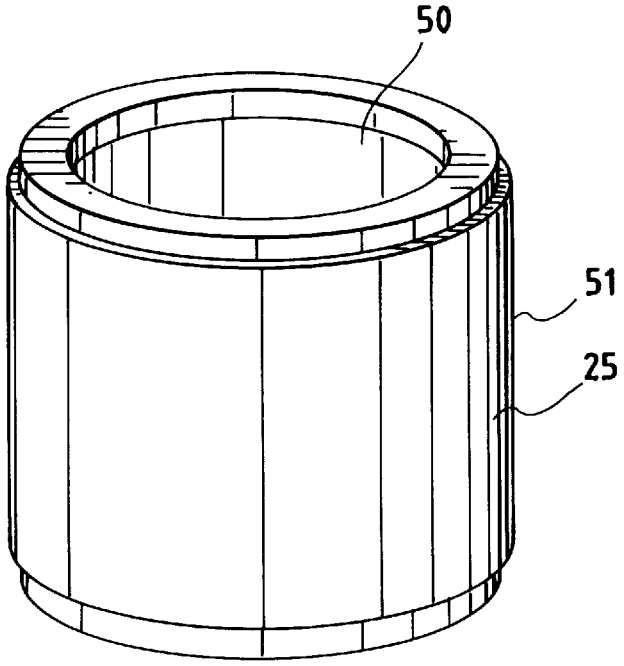
FIG. 10 is a perspective view of the ceramic tube of the transducer.

The ceramic tube 25 (FIG. 2) for the transducer assembly, as illustrated in FIG. 10, comprises a piezoelectric ceramic material with electrodes 50 and 51 on the inner and outer surfaces of the cylindrical wall, respectively. Both electrodes are etched back on both ends of the ceramic a small distance to allow for capture of the ceramic in the ceramic capture ring 42 of the back plate 31 and head mass 26 without resulting in a short circuit.

When a voltage is applied across the electrodes of the ceramic, the ceramic either expands or contracts in thickness. This motion is inconsequential to the operation of the device. At the same time, the ceramic also contracts or expands in length and circumference. The expansion and contraction in length is what drives the head mass in a longitudinal vibration.

The ceramic material is selected from the family of lead zirconate titanate (PZT), more specifically from the PZT-4 and PZT-8 ceramics. These particular ceramic materials are selected for their especially low value of dissipation factor or loss tangent, the parameter which relates to the tendency of the ceramic to generate heat as a result of large applied electric fields. The low heat abilities of these materials markedly overshadow the attendant reduced displacement.

The static "DC" longitudinal zero to peak displacement D of the cylindrical tube ceramic is given by the expression:

$$D=d_{31}V\,L/thk \qquad \text{(Equation 1)}$$

where $d_{31}$ is the piezoelectric charge constant, typically in the range from 97 to $122\times10^{-12}$ m/V for the PZT-8 and PZT-4, respectively, V is the applied zero to peak voltage, L is the length of the ceramic tube, thk is the thickness of the ceramic tube wall.

The displacements predicted by the above expression are modest, below the levels required for the hearing assist device. At resonance, however, the resonant frequency emission typically increases by 35 to 40 dB.

The above expression suggests that increased emission might be obtained by lengthening the ceramic and making the wall thinner. A lengthened cylinder competes with the accepted physical size of the device. Thinner walls require less applied voltage as the ceramics are limited by the maximum electric fields, not applied voltage. However, no benefit would be achieved.

The capacitances of typical ceramics are in the 7.5 nano Farad range.

The ceramic tube 25 is bonded to the back plate 31 and to the head mass 26 with an epoxy, typically with a penetrating epoxy.

Alternatively, the piezoelectric ceramic tube might be replaced in the electromechanical vibrator by a piezoelectric ceramic stack. The piezoelectric ceramic stack comprises a stack of ceramic washers of alternating piezoelectric polarity. Electrodes are wired in common, alternating along the length of the stack. The exchange of the ceramic stack for the ceramic tube will necessitate a minor redesign of the mating surfaces on the back plate and the head mass, the major difference being perhaps a greater wall thickness for the piezoelectric stack. This difference in wall thickness will affect the resonant frequency of the device.

Figure 11:
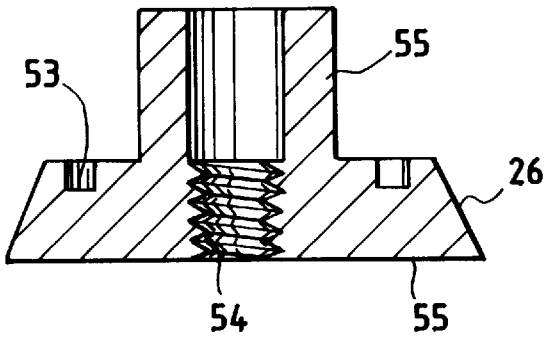
FIG. 11 is a sectional view of the head mass of the transducer.

The radiating head mass 26 is depicted in cross section in FIG. 11. The nominal diameter of the head mass is 0.50 inches. The head mass features a cylindrical groove 53 for ceramic retention, in the same manner as the back plate 31. The head mass also features at least four complete 4-40 threads 54 for the attachment of the tensioning rod 28 (FIG. 2). The face 55 of the head mass makes contact with the silicone cap 40 (FIG. 2). If the silicone cap material is clear, a fine machined surface is preferred. The head mass also features a cylindrical mass 55 of material extending toward the rear of the transducer, with an outer diameter less than the inner wall of the ceramic tube and an inner diameter which does not interfere with the tension rod. This extra material acts to stiffen the head mass and also to adjust the device resonant frequency.

Head masses are in the mass range from typically 0.5 grams to 7 grams, more typically in the range from 1.5 to 4 grams. Ideally, the mass of the head mass would be approximately 10 times less than the mass of the housing assembly. The head mass is typically fabricated from common metals, more typically from hardened metals, and preferably from hardened stainless steel, typically 416 stainless steel hardened to Rockwell 35. Alternatively, brass may be used for increased mass (lower frequency) or aluminum for decreased mass (higher frequency).

Figure 12:
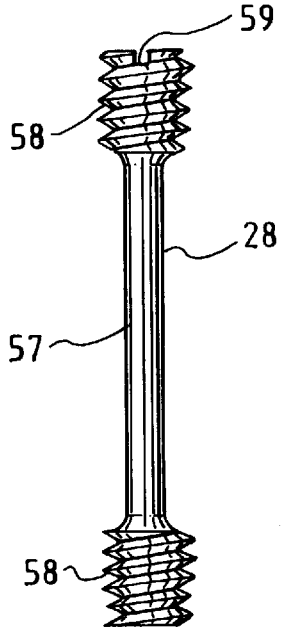
FIG. 12 is a perspective view of the tensioning rod of the transducer.

The tensioning rod 28 is depicted in FIG. 12. The rod features a thinned middle section 57 and at least four complete 4-40 threads 58 on each end. One end additionally features a slot 59 for a small screw driver. The rod is adhesively bonded into the head mass 26 with a penetrating epoxy such that the face of the head mass and the flat end of the rod are flush. During transducer assembly, the slotted end 59 of the rod is attached to the nut 32. The screw driver slot allows for the tensioning of the rod by the nut without exerting a torque on the nut which might twist the rod or exert a rotational shear on the ceramic.

The tensioning rod is typically fabricated from hardened stainless steel, typically 416 stainless steel hardened to Rockwell 35. A typical mass for the rod is 0.35 grams. The middle section 57 of the rod has a diameter at approximately 0.060 inches over a length of 0.49 inches.

The transducer can be effectively operated without a cover over the head mass 26. However, to protect the internal ceramic cylinder 26, a cap 40 (FIG. 2) is placed over the face of the transducer. This cap is typically from the family of materials referred to as silicone rubbers, more typically cast-in-place silicone rubber. A preferred material is a CF2-2186 silicone rubber manufactured by NuSil Technology, Inc. To assure excellent adhesion of the rubber to the head mass and housing, a silicone primer is typically used.

Rosenthal and Mikuteit suggested the resonant frequency of their device as:

$$\omega=\{2A/M\,s_{11}^{E}L\}^{1/2} \qquad \text{(Equation 2)}$$

where

A is the cross sectional area of the ceramic tube

M is the mass of the head mass, $s_{11}^{E}$ is the short circuit elastic constant, L is the length of the ceramic.

If the assumption of an infinite inertial or tail mass can be made, the resonant frequency of the current device can be approximated by the expression $$\omega=\{A/(M+M_c/3+M_r/3)s_{11}^{E}L\}^{1/2} \qquad \text{(Equation 3)}$$

where $M_c$ is the mass of the ceramic, $M_r$ is the mass of the rod.

Note the similarity of the expressions. The expression for the resonant frequency of the device can be further refined by adding terms for the internal friction of the ceramic (ceramic Q) and the radiation impedance of the medium (water or body tissue).

A typical resonant frequency for the transducer with the above mentioned materials, dimensions, and masses is on the order of 28 kHz. The resonant frequency is preferably within the range of about 20 Khz to 108 Khz, more preferably in the range from 20 to 40 Khz. Of note in the above expression, if the ceramic is made stiffer by decreasing the length or increasing the cross sectional area, the resonant frequency will go up. Also and more easily implemented, simply reducing the mass of the head mass will increase the resonant frequency of the device. Indeed, the subject transducer has been implemented with different head masses ranging from 0.6 to 6.4 grams, with subsequent resonant frequencies from 22 to 39 kHz. This broad range of frequency opportunities is especially useful in adjusting the transducer to match the particular deficit of the human subject, as discussed in greater detail in co-pending United States patent application entitled "Apparatus and Method for Determining Individual Sensitivity to Ultrasonic Signals," filed of even date herewith. Larger head masses may require a volume expansion of the device. This includes lengthening the housing, the tensioning rod, and the head mass itself.

Figure 13:
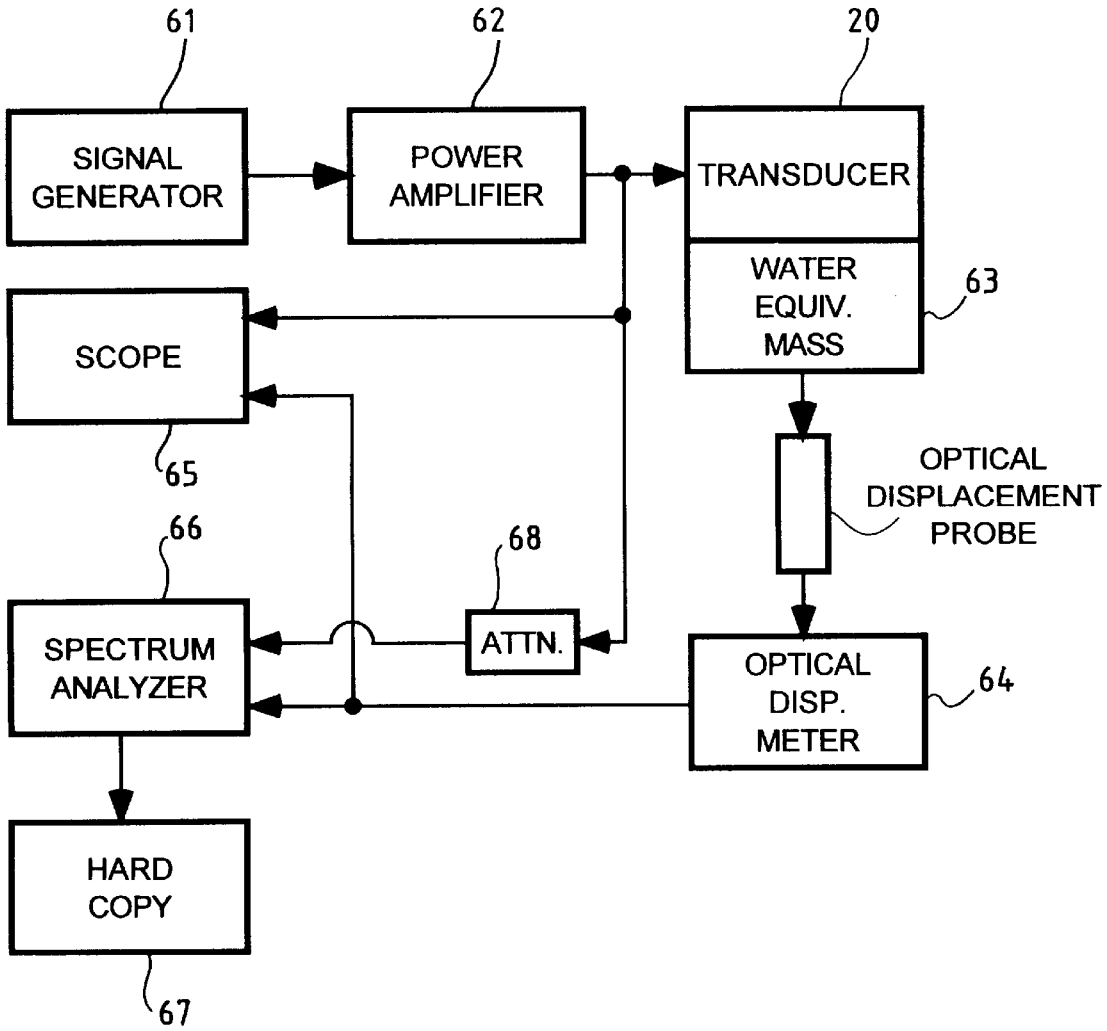
FIG. 13 illustrates one configuration of equipment in which the transducer can be used.

The performance of the transducers is best assessed with the experimental configuration in FIG. 13. A signal generator 61 is required to sweep a continuous wave signal across the band of operation of the transducer 20. The power amplifier 62 allows operation at any power level, to assess transducer response as a function of input level. The transducer is typically mounted in a vise, to best approximate the infinite inertial mass configuration. The transducer head mass is also fitted with a "water equivalent mass" 63 to compensate the measurements for the absence of the water (or tissue mass) medium which the transducer is designed to vibrate. The vibration of the head mass and the water equivalent mass is best measured with non-contacting optical displacement meter 64. (Alternatively, the displacement of the head mass can be measured without the use of a water equivalent mass, in water, with a laser interferometer). The input signal to the transducer and the output of the calibrated displacement meter are passed to a scope 65 and/or spectrum analyzer 66 which provides a hard copy output 67. The circuit also includes an attenuator 68.

Figure 14:
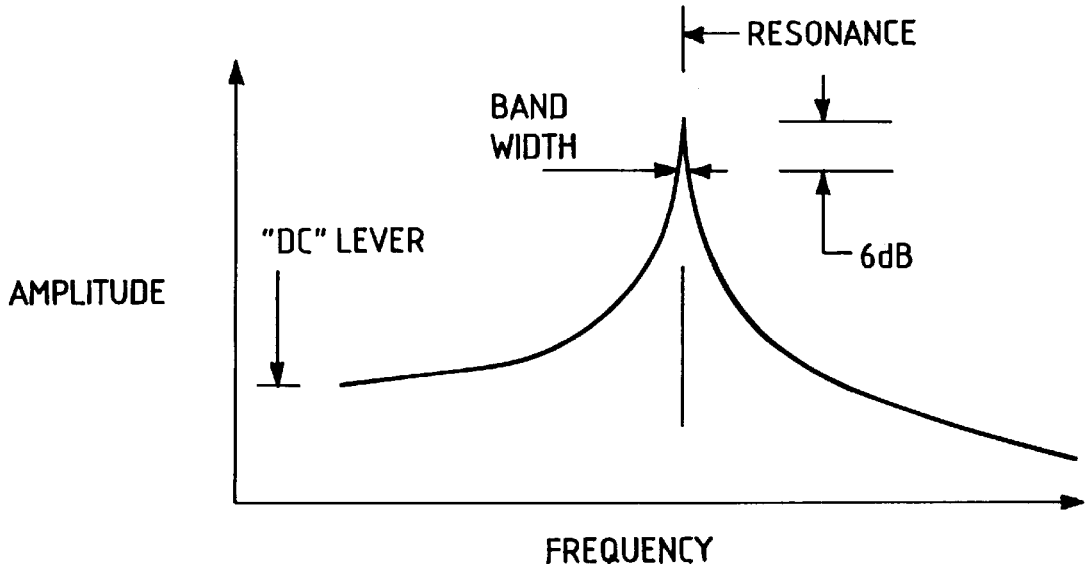
FIG. 14 illustrates a typical spectral response from the transducer.

A typical spectral response from a transducer using the above test method is illustrated in FIG. 14, for a constant amplitude input signal. The spectrum typically features a low level flat response at low frequencies, typically within a few dB of the value predicted by Equation 1 above. The resonant frequency is typically predicted by Equation 3 above, and the resonant amplitude is typically 35 to 40 dB above the "DC" static level. At high frequencies, the signal strength drops off rapidly. Of note, the band width at typically 6 dB down observed from an untuned transducer as seen in FIG. 14 is unacceptable, typically in the 1 kHz range. The band width can be significantly enhanced by implementation of a tuning circuit.

Figure 15:
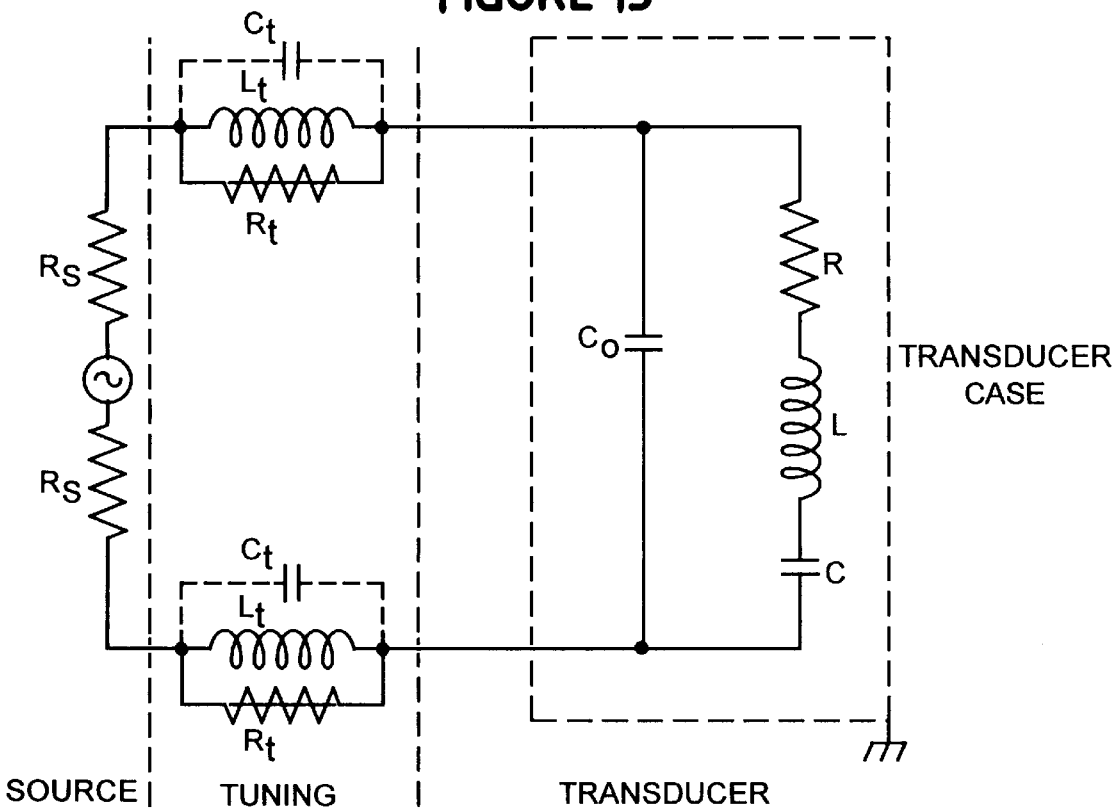
FIG. 15 illustrates the equivalent circuit for the transducer with a tuning circuit.

FIG. 15 depicts the equivalent circuit for the transducer with a tuning circuit. The system is operated in a push/pull mode (common mode). Each leg of the tuning circuit is identical. Within the transducer, the piezoelectric ceramic and transducer components can be modeled as a parallel R, L, C, and $C_o$ circuit, where the L and C define the electromechanical resonant frequency of the transducer, the R reflects the sink for conversion of electrical energy to mechanical energy, and $C_o$ the clamped "DC" capacitance of the ceramic.

Figure 16:
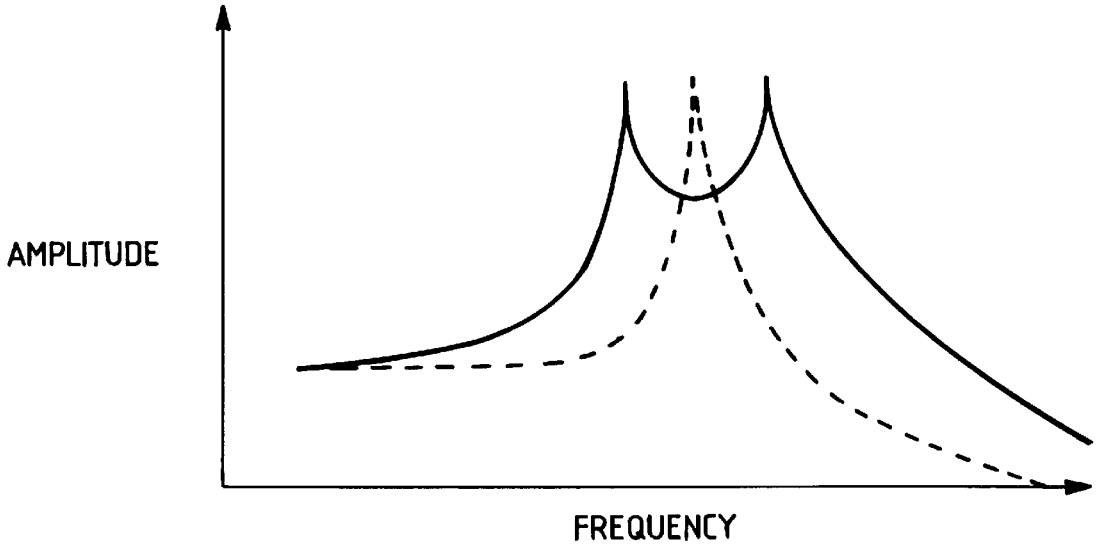
FIG. 16 illustrates an inductively tuned spectrum.
Figure 17:
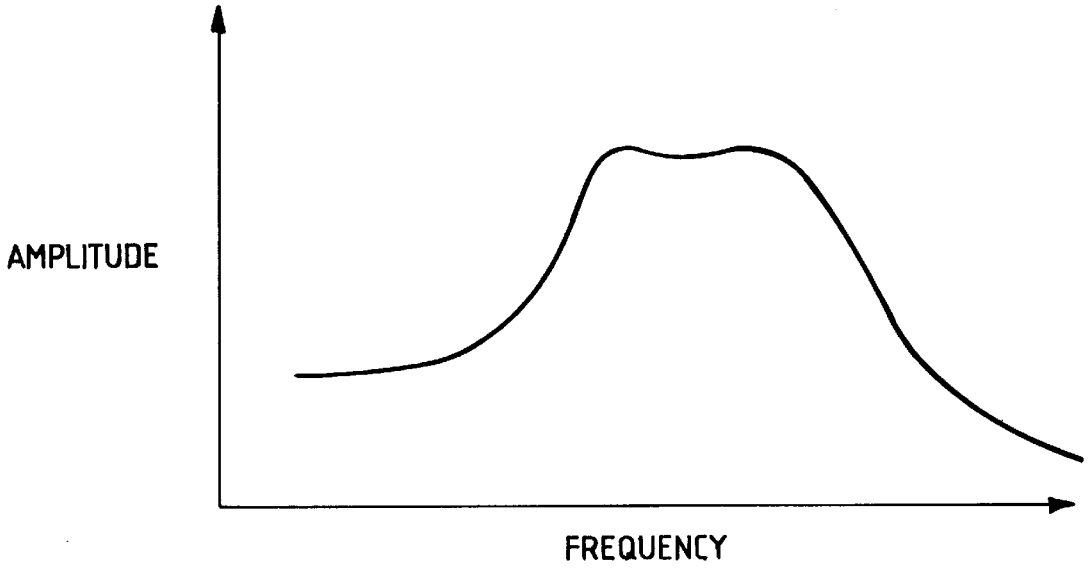
FIG. 17 illustrates a spectrum tuned with resistors and inductors.

When the combined value of the tuning inductors is such as to create a resonance with $C_o$ at the same frequency as the electromechnical resonance, the spectrum of FIG. 14 is split into that depicted in FIG. 16. If the inductive values are low, the resonance is at a higher frequency, and the higher frequency peak increases with respect to the lower frequency peak, and vice versa. While the band width is substantially increased, the remaining sharp spikes in the spectrum would result in too great a variation in amplitude for the human subject. Placing resistors across the inductors has the effect of lowering the spikes in the spectrum, to achieve the desired spectral response as depicted in FIG. 17. Increasing the values of the resistors will increase the amplitude of the spikes in the spectrum while reducing the values of the resistors will round off the entire spectrum, and additionally will consume greater power from the electronic drive system.

Parallel capacitors in the tuning circuit allow for fine tuning of the inductors to optimally match the tuned resonance with the device electromechanical resonance.

The variation of the two peaks can typically be held to less than 2 dB while the peak to null amplitude difference at the top of the spectrum can be held to less than 3 dB. Band widths can easily exceed 6 kHz.

For a transducer operating at typically 28 kHz, the inductive values of the tuning circuit are typically 2.4 milli Henry and the resistances typically have values of 3000 ohms.

The transducer cable 21 (FIG. 2) is typically a shielded twisted pair cable, with the twisted leads 37 and 38 providing common mode power to the transducer and the shield electrically connecting the transducer housing assembly and head mass to the system ground.

As stated above, variations in transducer frequency band can be achieved by changing the mass of the head mass 26. These variations will affect the value of the tuning inductor and resistor. The inductor values are directly predictable by the resonant frequency and the ceramic capacitance. The resistive values are generally in the range from 1000 ohms to 10,000 ohms, the value being selected in final test to achieve the requisite flatness across the top of the transducer spectrum.

The tensioning rod 28 through the middle of the transducer must have sufficient tension such that the head mass 26 is under compressive bias at all times, for any amplitude of emission, for any frequency. Newton's equation predicts the force on a mass undergoing oscillations at a specific frequency at a certain amplitude. In this case, the mass comprises the total mass of the head mass plus one third of the masses of the ceramic and the rod. The frequency under consideration corresponds to the highest frequency peak of the transducer spectrum.

When a piezoelectric ceramic is compressed under static pressure, the material will develop a voltage across the electrodes. For any ceramic, a charge corresponding to the maximum excursion of the head mass can be calculated. The ceramic leads are attached to an electrometer and the tensioning rod is torqued until the specified charge has developed plus a margin.

The transducer can also be used in a supersonic bone conduction hearing aid as described in Lenhardt U.S. Pat. No. 4,982,434, in the diagnosis and treatment of tinnitus as described in U.S. patent application entitled "Tinnitus Masking Using Ultrasonic Signals," Ser. No. 08/264,527, filed Jun. 23, 1994, and in other procedures and applications which utilize ultrasonic signals.

The invention can also be used to test a patient's vestibular function on the theory that if a patient cannot hear using the bone conduction device described herein, which we believe is mediated by the vestibular system, then there is a vestibular problem. The invention can also be used to treat vestibular function disorders say, for example, as a "vestibular masker" to lessen or alleviate motion sickness.

While in the foregoing specification a detailed description of specific embodiments of the invention were set forth for the purpose of illustration, it will be understood that many of the details herein given can be varied considerably by those skilled in the art without departing from the spirit and scope of the invention.

I claim:

1. A device for supersonic bone conduction hearing in human subjects for allowing some level of auditory sensation comprising:

means for generating signals in the supersonic range, an electromechanical transducer assembly for receiving said signals in the supersonic range and for providing a vibratory output, the transducer including an inertial mass, a vibrating head mass, a piezoelectric ceramic tube between the inertial mass and head mass, and a tensioning rod connected to the head mass and the inertial mass and extending through the ceramic tube, the tensioning rod exerting a compressive force on the ceramic tube, the transducer having a resonant frequency within the range of about 20 Khz to 108 Khz, the transducer assembly having a size smaller than the human head and being adapted to be placed against the human body, and tuning means for broadening the frequency response of the electromechanical transducer assembly.

2. The device of claim 1 in which the resonant frequency is within the range of about 20 kHz to 40 kHz.

3. A device for supersonic bone conduction hearing in human subjects for allowing some level of auditory sensation comprising:

means for generating signals in the supersonic range, an electromechanical transducer assembly for receiving said signals in the supersonic range and for providing a vibratory output, the transducer including an inertial mass, a vibrating head mass, a piezoelectric ceramic tube between the inertial mass and head mass, and a tensioning rod connected to the head mass and the inertial mass and extending through the ceramic tube, the tensioning rod exerting a compressive force on the ceramic tube, the transducer having a resonant frequency within the range of about 20 kHz to 108 kHz, and tuning means for broadening the frequency response of the electronomechanical transducer assembly, the inertial mass including a housing portion which substantially surrounds the ceramic tube and a cylindrical portion which extends inside of the ceramic tube.

4. The device of claim 3 in which the head mass includes a cylindrical portion which extends inside of the ceramic tube.

5. The device of claim 3 in which the inertial mass includes a nut portion which is threadedly engaged with the tensioning rod.

6. The device of claim 5 in which the nut portion of the inertial mass is rotatably mounted on the remainder of the inertial mass.

7. A device for supersonic bone conduction hearing in human subjects for allowing some level of auditory sensation comprising:

means for generating signals in the supersonic range, an electromechanical transducer assembly for receiving said signals in the supersonic range and for providing a vibratory output, the transducer including an inertial mass, a vibrating head mass, a piezoelectric ceramic tube between the inertial mass and head mass, and a tensioning rod connected to the head mass and the inertial mass and extending through the ceramic tube, the tensioning rod exerting a compressive force on the ceramic tube, the transducer having a resonant frequency within the range of about 20 Khz to 108 Khz, and tuning means for broadening the frequency response of the electronomechanical transducer assembly, the inertial mass and head mass being formed from metal selected from the class of steel, bronze, and aluminum.

8. The device of claim 7 in which the tensioning rod is formed from metal selected from the class of steel, bronze, and aluminum.

9. A device for supersonic bone conduction hearing in human subjects for allowing some level of auditory sensation comprising:

means for generating signals in the supersonic range, an electromechanical transducer assembly for receiving said signals in the supersonic range and for providing a vibratory output, the transducer including an inertial mass, a vibrating head mass, a piezoelectric ceramic tube between the inertial mass and head mass, and a tensioning rod connected to the head mass and the inertial mass and extending through the ceramic tube, the tensioning rod exerting a compressive force on the ceramic tube, the transducer having a resonant frequency within the range of about 20 kHz to 108 kHz, and tuning means for broadening the frequency response of the electronomechanical transducer assembly, the mass of the head mass being within the range of 0.5 to 7 grams.

10. The device of claim 9 in which the mass of the inertial mass is approximately 10 times the mass of the head mass.

11. The device of claim 9 in which the mass of the inertial mass is about 26 grams.

12. The device of claim 9 in which the mass of the head mass is within the range of 1.5 to 4 grams.

13. A device for supersonic bone conduction hearing in human subjects for allowing some level of auditory sensation comprising:

means for generating signals in the supersonic range, an electromechanical transducer assembly for receiving said signals in the supersonic range and for providing a vibratory output, the transducer including an inertial mass, a vibrating head mass, a piezoelectric ceramic tube between the inertial mass and head mass, and a tensioning rod connected to the head mass and the inertial mass and extending through the ceramic tube, the tensioning rod exerting a compressive force on the ceramic tube, the transducer having a resonant frequency within the range of about 20 kHz to 108 kHz, and tuning means for broadening the frequency response of the electronomechanical transducer assembly, the tuning means comprising a tuning circuit having a pair of tuning inductors connected in parallel to the transducer, the ceramic tube having a clamped DC capacitance of $C_o$, the combined value of the tuning inductors creating a resonance with $C_o$ at the same frequency as the electromechanical resonant frequency of the transducer.

14. The device of claim 13 including a tuning resistor connected in parallel with each of the tuning inductors.

15. The device of claim 1 including a rubber cap mounted on the head mass.

16. A method for providing auditory sensation to humans in the supersonic range comprising the steps of:

placing an electromechanical transducer against the human body, the transducer including an inertial mass, a head mass, a piezoelectric ceramic tube between the inertial mass and the head mass, a tensioning rod connected to the head mass and the inertial mass and extending through the ceramic tube, the tensioning rod exerting a compressive force on the ceramic tube, the transducer having a resonant frequency within the range of about 20 kHz to 108 kHz, and tuning means for broadening the frequency response of the transducer, and generating signals in the supersonic range and delivering said signals to the tuning means so that the transducer provides a vibratory output having a wide band frequency response in the supersonic range.

17. The method of claim 16 in which the transducer is placed against the mastoid bone of the human skull.

18. The method of claim 16 in which the transducer is placed against the wall of the human ear canal.

19. The method of claim 16 in which the transducer is placed against the human forehead.

20. The method of claim 16 in which the transducer is placed against the human tooth.

21. The method of claim 16 in which the transducer is placed against the human clavicle.

22. The method of claim 16 in which the transducer is placed against the human spine.

23. The method of claim 16 in which the transducer is placed against human bones.

24. A method of supersonic bone conduction for the diagnosis and treatment of tinnitus in a patient comprising the steps of:

placing an electromechanical transducer against the the patient body, the transducer including an inertial mass, a head mass, a piezoelectric ceramic tube between the inertial mass and the head mass, a tensioning rod connected to the head mass and the inertial mass and extending through the ceramic tube, the tensioning rod exerting a compressive force on the ceramic tube, the transducer having a resonant frequency within the range of about 20 Khz to 108 Khz, and tuning means for broadening the frequency response of the transducer, and generating masking noise signals in the supersonic range and delivering said signals to the tuning means so that the transducer provides a vibratory output having a wide band frequency range in the supersonic range so that the vibratory output of the transducer masks tinnitus in the patient.

25. A method of supersonic bone conduction for the diagnosis and treatment of vestibular function conditions in a patient comprising the steps of:

placing an electromechanical transducer against the body of the patient, the transducer including an inertial mass, a head mass, a piezoelectric ceramic tube between the inertial mass and the head mass, a tensioning rod connected to the head mass and the inertial mass and extending through the ceramic tube, the tensioning rod exerting a compressive force on the ceramic tube, the transducer having a resonant frequency within the range of about 20 Khz to 108 Khz, and tuning means for broadening the frequency response of the transducer, generating signals in the supersonic range and delivering said signals to the tuning means so that the transducer provides a vibratory output having a wide band frequency response in the supersonic range, and determining whether the patient can perceive the vibratory output of the transducer.

26. A method of supersonic bone conduction for echo location comprising the steps of:

placing an electromechanical transducer against the human body, the transducer including an inertial mass, a head mass, a piezoelectric ceramic tube between the inertial mass and the head mass, a tensioning rod connected to the head mass and the inertial mass and extending through the ceramic tube, the tensioning rod exerting a compressive force on the ceramic tube, the transducer having a resonant frequency within the range of about 20 kHz to 108 kHz, and tuning means for broadening the frequency response of the transducer, and generating signals in the supersonic range and delivering said signals to the tuning means so that the transducer provides a vibratory output having a wide band frequency response in the supersonic range.

27. A device for supersonic bone conduction hearing in human subjects for allowing some level of auditory sensation comprising:

means for generating signals in the supersonic range, an electromechanical transducer assembly for receiving said signals in the supersonic range and for providing a vibratory output, the transducer including an inertial mass, a vibrating head mass, a piezoelectric ceramic stack between the inertial mass and head mass, and a tensioning rod connected to the head mass and the inertial mass and extending through the ceramic stack, the tensioning rod exerting a compressive force on the ceramic stack, the transducer having a resonant frequency within the range of about 20 kHz to 108 kHz, the transducer assembly having a size smaller than the human head and being adapted to be placed against the human body, tuning means for broadening the frequency response of the electromechanical transducer assembly.

* * * * *